United States Patent [19]

Combette et al.

[11] 4,333,595

[45] Jun. 8, 1982

[54] OFFSET PISTON FOR POWDER ACTUATED TOOLS

[75] Inventors: Marc Combette; Jean Ollivier, both of Valence, France

[73] Assignee: Olin Corporation, New Haven, Conn.

[21] Appl. No.: 138,788

[22] Filed: Apr. 9, 1980

[30] Foreign Application Priority Data

Apr. 10, 1979 [GB] United Kingdom ..... 7912654

[51] Int. Cl.[3] ..... B25C 1/14; B25C 1/18

[52] U.S. Cl. ..... 227/10; 42/1 R; 92/177

[58] Field of Search ..... 42/1 R; 92/129, 169, 92/171, 177; 227/8, 9, 10, 11

[56] References Cited

U.S. PATENT DOCUMENTS

| | | | |
|---|---|---|---|
| 1,137,446 | 4/1915 | Allen | 92/177 X |
| 3,040,326 | 6/1962 | DeCaro | 227/10 |
| 3,044,071 | 7/1962 | Behrend | 227/10 |
| 3,338,141 | 8/1967 | Ramsay | 227/10 X |
| 3,424,361 | 1/1969 | Bayer | 227/10 |

FOREIGN PATENT DOCUMENTS

| | | | |
|---|---|---|---|
| 1277541 | 10/1961 | France | 92/177 |

*Primary Examiner*—Paul A. Bell
*Attorney, Agent, or Firm*—Paul J. Lerner

[57] ABSTRACT

A powder-actuated tool is provided with a barrel assembly having two parallel, communicating bores and a piston comprised of joined, offset portions, with one of said portions being adapted to slide in one bore while another portion is sliding in the other bore, whereby it is possible to provide a relatively short tool, capable of setting long fasteners, with continuous centering, of the fasteners, during their displacement.

12 Claims, 7 Drawing Figures

OFFSET PISTON FOR POWDER ACTUATED TOOLS

BACKGROUND

The present invention relates to cartridge-operated fastening tools and, more specifically, to the type of such tools in which a fastener is driven into hard materials by a captive piston adapted to be propelled by the combustion gases of an explosive load, for instance a blank cartridge.

Such tools are known in the art. They have been described, for example, in British Pat. Nos. 734,344, 834,293, 901,023 and German Pat. No. 1,224,218. In the above patents, the fasteners are guided in differring ways. In Pat. No. 834,293, a stud is assembled in a two-piece piston. This is a lengthy operation. Further, it is necessary, to separate the two pieces, of the piston, after the tool has been fired. No realistic guidance means are proposed for nails. At best, it is necessary to use a different piston when the stud diameter is different. The disadvantages are such that this type of tool has been abandoned.

In German Pat. No. 1,224,218, the centering means comprise a recess in the piston for the fastener head and a plastic washer, flexible enough to slide in two different diameter bores. A movable steel washer may be carried on the fastener shank, proximate the nose. This method does not yield a quality fixing. Further, a special ramrod is necessary to load a new fastener in the tool and return the piston to the firing position. Therefore, although these means lead to light pistons and short tools, this type of tool has not been successful.

In British Pat. Nos. 734,344 and 901,023, the fasteners have two centering means. In both cases, a muzzle bushing is provided, for co-operation with a steel or plastic washer assembled on the fastener shank. In the British Pat. No. 734,344, the second means comprises the fastener head, or a cap on it, co-operating with the same muzzle bushing. In Pat. No. 901,023, the second centering means comprises a recess in the front part of the piston, in which the fastener head or a rear extension is inserted.

In both patents, the front part of the piston is centered in the muzzle bushing prior to any displacement and, consequently, the length of the portion of the piston shank which is slidable in the muzzle bushing must necessarily be somewhat greater than the length of the longest fastener usable in the tool. This results in serious limitations on usable fastener lengths, as long fasteners, for instance 4 or 5 inches long, would require an excessively long tool and heavier pistons than desired.

SUMMARY OF THE INVENTION

It is, therefore, a primary object of the present invention to avoid or overcome the above mentioned difficulties. This is accomplished by providing the tool body with two parallel bores, either partly tangent, or separate and including a communicating slot, in order to allow the displacement of a piston adapted to have at least one portion sliding in one bore while another portion is sliding in the other bore. This feature is particularly advantageous in that the piston may be guided in the bore with a cartridge chamber, i.e., the barrel, while the fastener is centered on its whole length, without requiring a long piston. It is thereby possible to provide a relatively short tool, capable of setting long fasteners, with continuous centering, of the fasteners, during their displacement.

The present invention offers other advantages owing to the availability of a front transverse surface or wall on the propelled and guided piston part, and of a rear wall on the pushing part. These walls may be used for a variety of purposes, such as piston buffering, power adjustment, tool safety, easy unloading of fasteners, etc.

Further advantages may be obtained from the present invention. Means may be provided to adjust the length of one of the bores, while the other bore has a constant or differently adjustable length. Alternatively, the two bores may be arranged so as to be relatively sliding, whereby their relative axial lengths may be varied. Such features are useful for piston return after firing, for side fastener loading, or for controlling overdrive of the piston.

Another advantage of the present invention, is the ability, when the muzzle bushing is opposite to the handle, to drive fasteners very near a corner or a perpendicular wall.

BRIEF DESCRIPTION OF THE DRAWING

The above and other objects and advantages of the present invention, as may hereinafter appear, may be more clearly understood by reference to the following description, claims and drawing, wherein:

DESCRIPTION OF THE PREFERRED EMBODIMENTS

Figure 1:
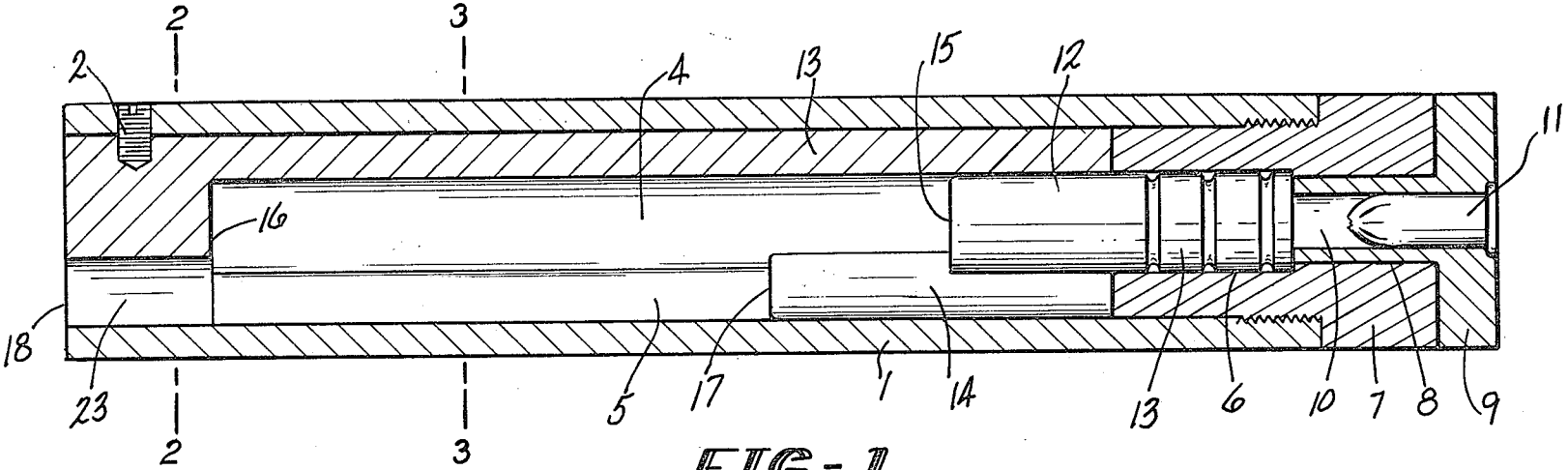
FIG. 1 is a longitudinal sectional view of a tool according to the invention.
Figure 4:
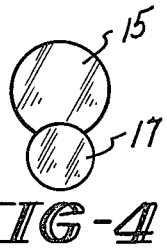
FIG. 4 is a front view of the piston shown on FIG. 1.
Figure 5:
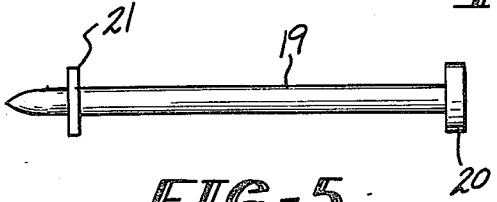
FIG. 5 is a longitudinal view of a fastener provided with a washer.
Figure 3:
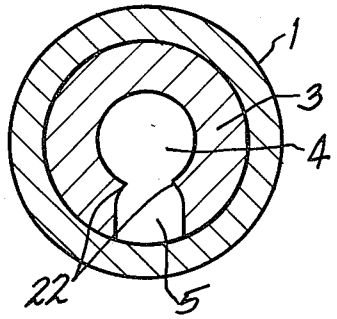
FIG. 3 is a cross sectional view taken on the line 3—3 of FIG. 1.
Figure 2:
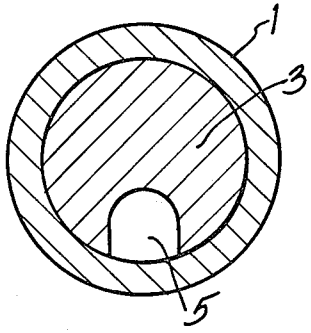
FIG. 2 is a cross sectional view taken on the line 2—2 of FIG. 1.

Referring now to the drawing, there is shown a barrel assembly including a cylindrical sleeve 1, inside of which is secured, by a screw 2, an elongated member 3 provided with first and second longitudinal bores 4 and 5 respectively, the first bore 4 being closed on the left side and open on the right side, while the second bore 5 is open on the left side and, closed on the right side. The first bore 4 communicates with a concentric breech bore 6, of like diameter, in a socket 7 on which the sleeve 1 is screwed. The breech bore 6, in turn, communicates with a chamber bore 8 in the socket 7. In chamber bore 8, there is mounted a cartridge plug 9 having a cavity 10 which comprises the chamber of the tool and which is adapted to receive a cartridge 11.

inside the bores 4, 5 and 6 is a piston 12, which is provided with a rear extension 13 and a pushing rod 14. The rear extension 13 slides in the bores 4 and 6. In the position shown on FIG. 1, this extension 13 is ready to be thrust forward by combustion gases generated by ignition of the cartridge 11 until either its kinetic energy is absorbed by the accomplished work or piston wall 15 abuts against elongated member wall 16. During this displacement the rear extension 13 drives the pushing rod 14 which, in turn, by its wall 17 drives the head 20 of a fastener 19 which has been inserted in the second bore 5 between the outer end 18 of the tool and the front wall 17 of the rod 14. The tool being pressed against the part to be fastened, the fastener 19 will first penetrate it, then the bearing material.

It is important, for a good fixing, to guide the fastener 19, which is acted upon by asymmetric strains. This is accomplished by providing the fastener 19 with a washer 21 of the same diameter as the fastener head 20.

The cross-section of the second bore 5 is such that the head 20 can freely slide through it without substantial radial play. A hemispherical slot 22 is milled in the elongated member 3, communicating between the first and second bores 4 and 5, the slot diameter being slightly larger than the head 20 diameter. In the area where bores 4 and 5 are tangent, the head 20 and eventually the washer 21 are centered by two portions 22 of a circle and the sleeve 1. Until now, the invention has been described in its simplest embodiment. The piston return and the cartridge ejection are accomplished by use of a ramrod (not shown). The tool must use a cartridge of an appropriate energy level.

The improved barrel and piston configuration of the present invention, make possible further improvements, to the basic tool.

Figure 6:
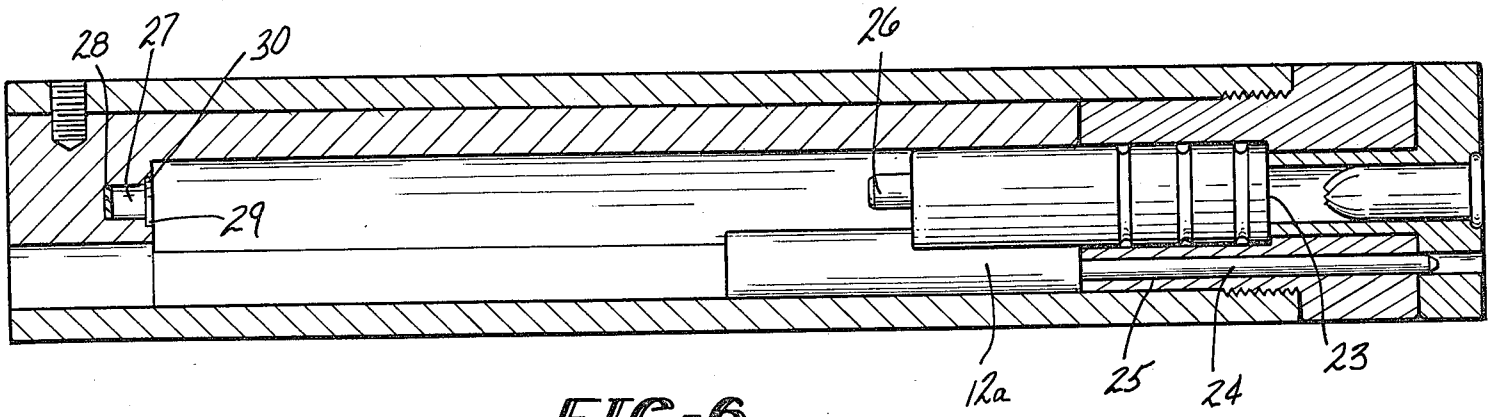
FIG. 6 is a longitudinal sectional view of a second embodiment of the invention.
Figure 7:
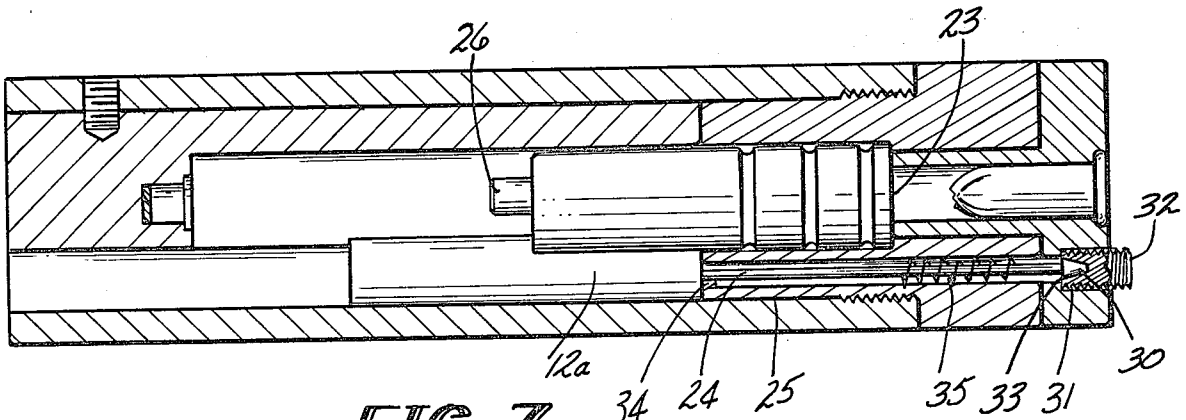
FIG. 7 is a longitudinal sectional view of a third embodiment of the invention.

For instance, as seen in FIG. 6, the piston 12*a* may be provided with a second rear portion 24, sliding in an extension 25 of the second bore 5 and sealing it. The extension bore 25 may extend through the tool handle (not shown). The rear portion 24 may be of such length that a part of it is never exposed to the combustion gases.

The end of rear portion 24 may take the form of a truncated cone 30, adapted to mate, when the piston 12*a* is in its most rearward position, with a corresponding conical recess 31 in the tool. A frictional fit, between the rear portion 24 and the extension bore 25, prevents the piston 12*a* from moving during handling of the tool and may be used, from a ballistical standpoint, to allow the piston 12*a* displacement only when a predetermined pressure has been reached in the chamber after firing the cartridge 11.

The extension 24 can be combined with an adjustable abutment 32 in order to control the volume between the rear wall 23 of the piston rear extension 13 and the cartridge 11.

The extension 24 can also be used to pull the piston 12 back after use of the tool. This can be done manually, or automatically in opening the tool. For example, a radial extension 33 may be provided at the right end of extension 24 which, at the beginning of the tool opening, would abut a fixed part of the tool handle. By sliding the sleeve toward the left, the piston is caused to travel in the bores 4, 5 then 6 until its return.

The radial extension 33 may also be used as a stop for the piston when the cartridge has delivered too much energy. In such case, it cooperates with a radial extension or fixed part 34 of the tool which may be a shearable part. Further, there may be a spring 35 between the radial extension and the fixed part or other spring arrangements may be provided for buffering of the piston.

The extension 24 may also control a "drop-fire" safety system, preventing any piston movement if the tool discharges on being accidentally dropped. A slot on end 24 adapted to a guillotine device could stop the piston as long as the trigger does not move the guillotine device out of the way of end 24.

If the extension bore 25 is open at the rear end of the handle (not shown), a bar of adequate size may be inserted in the bore 25 to displace the piston. This allows removing a fastener from a tool in which it has been loaded. Further, the second rear portion 24 may be used to control a cartridge extractor.

The front wall 15 of the piston 12 may be used to limit piston displacement in an overpower situation. This wall 15 can be drilled and threaded to receive a small piston 26, having a cross-section fitting a corresponding recess 27 in end portion 16 of the elongated member 3, whereby a pneumatic cushioning will result. In addition, the recess 27 may be partly filled with an elastomer 28.

Alternatively, the piston 26 and recess 27 may be inverted, the piston 26 being carried on wall 16 and the recess 27 drilled in front wall 15. The piston 26 and recess 27 may also be used as punch and die to punch a steel washer 29 installed in a recess 30 provided in the wall 16. Furthermore, the front wall 16 may be slidable against the springs of an external buffering system.

The return of the piston 12 to firing position may be accomplished in a variety of ways. The parts defining the first "bore" 5 may be slidable relative to the elongated member 3, the sliding parts functioning to position the piston 12 at the rear end of the elongated member. During that slide, the longitudinal slot between bores 4 and 5 is progressively uncovered. When two small transversal slots are provided to give the way to the head 20 and the washer 21, a lateral loading of the fastener 19 is possible.

It is also possible, by means of an adjustable abutment, to vary the relative positions of the wall 18 and the remaining parts of the tool, thereby limiting overdrive of the pushing rod 14.

Furthermore, piston 12 may be made of several individual parts assembled together, with cushioning means being included between them.

Also the central part of the piston 12 may be weakened at a location chosen to assure retention of all portions of part failing by reason of metal fatigue.

It is to be understood that various changes in details and arrangement of parts may be made by one skilled in the art without departing from the spirit of the present invention which is intended to be limited in scope only by the appended claims.

What is claimed is:

1. An improved barrel assembly for a powder-actuated tool comprising a right cylindrical barrel member and a piston, said barrel member being provided with first and second communicating, longitudinal bores, said bores each being transversely offset and each being closed at one end and opening into opposite ends of said barrel member, said piston comprising at least a first portion slidable in said first bore and a second portion slidable in said second bore.

2. The invention of claim 1, further comprising cartridge-receiving means proximate the open end of said first bore, said second bore being adapted to receive and guide a fastener to be driven.

3. The invention of claim 2, further comprising a third longitudinal bore, in the cartridge-receiving end of said barrel member, and a third portion of said piston slidable therein, said third piston portion frictionally engaging the wall of said third bore, whereby movement of said piston in said barrel member may be controlled.

4. The invention of claim 3, wherein the distal end of said third piston portion is formed as a truncated cone and an end wall of said third bore is formed with a first recess adapted to receive said distal end.

5. The invention of claim 4, wherein said end wall of said third bore is axially displaceable, whereby initial volume of said barrel assembly may be controlled.

6. The invention of claim 3, further comprising a radially extending shoulder on the distal end of said third piston portion adapted to cooperate with a radially extending abutment in said third bore, whereby overdrive of said piston may be prevented.

7. The invention of claim 6, further comprising a resilient member carried on said third piston member, between said shoulder and said abutment, for buffering of said piston.

8. The invention of claim 3, wherein said third bore communicates with the exterior of said barrel member, whereby said piston may be displaced by means of a rod inserted into said third bore, to unload a fastener previously inserted into said barrel member.

9. The invention of claim 2, further comprising a protrusion on one of said piston and the end wall of said first bore, and a mating second recess on the other of said piston and said end wall, said protrusion being adapted to enter said second recess at the end of the stroke of said piston, whereby a pneumatic cushioning of said piston is achieved.

10. The invention of claim 9, further comprising an elastomeric material partly filling said second recess.

11. The invention of claim 10, further comprising a metal washer and means for retaining said washer in covering relation to said second recess, whereby said washer and said third piston portion serve as a punch and die to absorb excess piston energy.

12. In a fastener driving tool of the type including a barrel and a piston adapted to slide within said barrel under the action of combustion gases produced by an explosive load and to propel a fastener previously inserted into said barrel, the improvement comprising said piston being formed with a rearward portion, which is driven by the pressure of the combustion gases, and a forward portion which drives a fastener, said two portions extending parallely and overlappingly to each other and being offset transversely of the longitudinal direction of the barrel, said portions sliding within first and second intersecting, longitudinally extending parallel bores, said first bore, in which said forward portion slides, being open only at the forward end of said barrel and said second bore, in which said rearward portion slides, being open only towards said explosive load, and in the overlapping region, said bores being connected by a slot receiving a portion of said piston connecting said forward and rearward portions thereof.

* * * * *